US012235069B1

(12) United States Patent
Liu

(10) Patent No.: US 12,235,069 B1
(45) Date of Patent: Feb. 25, 2025

(54) TOY GUN

(71) Applicant: Chengyuan Liu, Shantou (CN)

(72) Inventor: Chengyuan Liu, Shantou (CN)

( * ) Notice: Subject to any disclaimer, the term of this patent is extended or adjusted under 35 U.S.C. 154(b) by 0 days.

(21) Appl. No.: 18/824,059

(22) Filed: Sep. 4, 2024

(51) Int. Cl.
*F41B 11/642* (2013.01)

(52) U.S. Cl.
CPC ..... *F41B 11/642* (2013.01)

(58) Field of Classification Search
CPC ..... F41B 11/642; F41B 11/646; F41B 11/71; F41B 11/57; F41B 11/73; F41B 11/55; F41B 11/89
USPC ..... 124/66, 67, 71, 45, 64, 56, 65, 73
See application file for complete search history.

(56) References Cited

U.S. PATENT DOCUMENTS

| | | | | |
|---|---|---|---|---|
| 7,975,683 | B1 * | 7/2011 | Williams | F41B 11/71 124/67 |
| 11,644,271 | B1 * | 5/2023 | Huang | F41B 11/89 124/56 |
| 2006/0243263 | A1 * | 11/2006 | Tsurumoto | F41B 11/55 124/66 |
| 2007/0000483 | A1 * | 1/2007 | Tsurumoto | F41A 17/36 124/45 |
| 2007/0283941 | A1 * | 12/2007 | Tai | F41B 11/642 124/67 |
| 2007/0283942 | A1 * | 12/2007 | Tai | F41B 11/642 124/67 |
| 2010/0065033 | A1 * | 3/2010 | Yang | F41B 11/642 124/66 |
| 2015/0308783 | A1 * | 10/2015 | Lee | F41B 11/89 124/71 |
| 2017/0234644 | A1 * | 8/2017 | Cheng | F41B 11/642 124/71 |
| 2018/0112948 | A1 * | 4/2018 | Iwasawa | F41B 11/643 |

FOREIGN PATENT DOCUMENTS

| | | | |
|---|---|---|---|
| CN | 112923792 | A | 6/2021 |
| CN | 214582793 | U | 11/2021 |
| CN | 215653816 | U | 1/2022 |

* cited by examiner

*Primary Examiner* — Michael D David
(74) *Attorney, Agent, or Firm* — Nitin Kaushik

(57) ABSTRACT

The present invention belongs to the technical field of shooting toys, and relates to a toy gun. The toy gun includes: a gun body support, where a gun barrel communicating with a chamber, and a pellet supplying pipeline communicating with a pellet clip bin and the chamber are arranged on the gun body support; a piston assembly slidably mounted on the gun body support, where a firing spring is arranged between the piston assembly and the gun body support, and the firing spring is used for, through elastic force, driving the piston assembly to generate compressed gas to fire pellets; a motor, where the motor, through a gear set, drives the piston assembly to slide to compress the firing spring; a power supply electrically connected to the motor and used for supplying electricity.

13 Claims, 15 Drawing Sheets

TOY GUN

TECHNICAL FIELD

The present invention belongs to the technical field of shooting toys, and relates to a toy gun.

BACKGROUND

As a toy that uses air pressure to drive water pellets to be shot, when the motor drives the piston, continuous shooting can be achieved, having high playability. Moreover, due to soft texture of water pellets, the danger of playing with the water pellet gun is relatively low.

However, an existing electric water pellet gun is not emulational enough during shooting, and compared to real firearms, a toy gun lacks the action of unloading during shooting. This makes shooting experience lack realism, especially for users who pursue simulation effects, this defect is particularly obvious.

SUMMARY

In view of the shortcomings in the prior art, an objective of the present invention is to provide a toy gun with a sliding sleeve which imitates an unloading action during shooting.

To achieve the foregoing objective, the present invention adopts the following technical solution:

the toy gun includes:

a gun body support, where a gun barrel communicating with a chamber, and a pellet supplying pipeline communicating with a pellet clip bin and the chamber are arranged on the gun body support;

a piston assembly slidably mounted on the gun body support, where a firing spring is arranged between the piston assembly and the gun body support, and the firing spring is used for, through elastic force, driving the piston assembly to generate compressed gas to fire pellets;

a motor, where the motor, through a gear set, drives the piston assembly to slide to compress the firing spring;

a power supply electrically connected to the motor and used for supplying electricity; and a sliding member slidably mounted on the gun body support, where a first unloading bump is arranged on the piston assembly, a second unloading bump is arranged on the sliding member, the second unloading bump is located behind the first unloading bump, and when the motor drives the piston assembly to compress backwards the firing spring, the first unloading bump generates interference with the second unloading bump and drives the sliding member to slide backwards.

Further, the piston assembly includes an outer sleeve and a piston push rod, where one end of the outer sleeve is sleeved on the surface of the piston push rod to form an air cavity, an air outlet communicating with the cavity is formed in the other end of the outer sleeve, and the piston push rod is in sliding connection to the outer sleeve;

the gear set includes a multiple-stage gear and a plurality of transmission gears, first gear teeth and second gear teeth are arranged on the multiple-stage gear, and a radius of the first gear teeth is smaller than that of the second gear teeth; and a rack portion is arranged on the surface of the outer sleeve and the surface of the piston push rod, the first gear teeth are engaged with the outer sleeve, the second gear teeth are engaged with the piston push rod, and the first gear teeth and the second gear teeth are in partial circular array, such that the multiple-stage gear is indirectly engaged with the outer sleeve and the piston push rod.

Further, the first unloading bump is located on the surface of the outer sleeve.

Further, the air outlet extends outwards to form a pellet pushing bump;

pellet pushing flexible glue is arranged at an end head of the pellet pushing bump; and the pellet pushing bump is used for pushing pellets in the chamber into the gun barrel, and when the pellet pushing bump pushes the pellets into the gun barrel, the pellet pushing flexible glue and the gun barrel form seal.

Further, a first loading bump is arranged on the piston push rod, and a second loading bump is arranged on the sliding member; and the second loading bump is located in front of the first loading bump, and when a user slides the sliding member backwards, the second loading bump generates interference with the first loading bump and drives the piston push rod to compress backwards the firing spring.

Further, a piston lock is hinged in the gun body support, and a locking spring is arranged between the piston lock and the gun body support so as to ensure that the piston lock can reset after being stressed;

the piston lock is located behind the piston push rod, and a locking slot of which the position corresponds to that of the piston lock is formed in the piston push rod;

when the piston push rod moves backwards, the locking slot of the piston push rod generates interference with the piston lock, and the piston lock avoids temporarily under the action of pushing force to allow the piston push rod to pass through; and after the piston push rod completely passes through the piston lock, the locking spring pushes the piston lock to reset to an initial position to be clamped into the locking slot of the piston push rod, and the piston push rod is locked at a position after movement afterwards such that a piston is fixed.

Further, a sliding stroke in which the motor, through the second gear teeth, drives the piston push rod is a first stroke distance;

a stroke in which the sliding member, through the second loading bump, enables the piston push rod to cooperate with the piston lock is a second stroke distance; and the first stroke distance is smaller than the second stroke distance.

Further, a trigger is hinged to the gun body support, and a micro switch and a trigger bar are arranged on two sides of the trigger respectively;

the micro switch is arranged on an electric loop of the motor, and when the trigger rotates, the trigger generates interference with the micro switch to enable the micro switch to be switched on; and two ends of the trigger bar are abutted against the trigger and the piston lock respectively, and when the trigger rotates, the trigger, through the trigger bar, drives the piston lock to be away from the piston push rod.

Further, the toy gun further includes a gear switch, where the gear switch is arranged on the electric loop of the motor.

Further, the toy gun further includes a gear sliding block, where the gear sliding block is slidably arranged on the gun body support to be abutted against the gear switch;

a limiting bump is arranged on the gear sliding block, and a limiting slot is formed in a lower edge of the sliding member; and when the gear sliding block controls the gear switch to be switched off, the limiting bump is separated from the limiting slot, and when the gear sliding block controls the gear switch to be switched on, the limiting bump is located in the limiting slot to be used for limiting the sliding stroke of the sliding member.

Further, the toy gun further includes a pellet supplying sliding block slidably mounted on the gun body support, where the pellet supplying sliding block is located behind the outer sleeve, and the pellet supplying sliding block extends to the pellet clip bin to form a pellet supplying bump; and when moving backwards, the outer sleeve generates interference with the pellet supplying sliding block and drives the pellet supplying sliding block to slide backwards, and the pellet supplying bump is used for driving a pellet clip to supply pellets.

Further, the pellet clip is detachably mounted in the pellet clip bin and includes:

a pellet bin used for accommodating the pellets, where a rotating wheel is arranged at a bottom end of the pellet bin;

the rotating wheel mounted at the bottom end of the pellet bin, where a pellet supplying gap is formed between the rotating wheel and the bottom end of the pellet bin, and grooves for accommodating the pellets are formed in the edge of the rotating wheel;

a pellet pipeline, where one end of the pellet pipeline communicates with the pellet supplying pipeline, and the other end of the pellet pipeline extends to the rotating wheel;

one side of the rotating wheel, that is close to the pellet bin, is a pellet inlet, one side of the rotating wheel, that is close to the pellet pipeline, is a pellet supplying opening, and when the rotating wheel rotates, the grooves are used for transferring the pellets of the pellet bin to the pellet pipeline.

Further, the rotating wheel is provided with a notch wheel which is concentric therewith and located outside the pellet clip bin;

a bar assembly is slidably arranged in the pellet clip, one end of the bar assembly extends to a top end of the pellet clip, and the other end of the bar assembly extends to the notch wheel; and a pawl for driving the notch wheel to rotate is arranged at a bottom end of the bar assembly, the pellet supplying bump is provided with a bevel for driving the bar assembly to perform downward compressing, and when the pellet supplying bump of the pellet supplying sliding block generates interference with the bar assembly and drives the bar assembly to slide downwards, the pawl drives the notch wheel to rotate.

By adopting the technical solution of the present invention, the first unloading bump and the second unloading bump are in cooperation, such that when the piston assembly is driven by the motor to move backwards, the sliding member can be driven to slide backwards so as to simulate an unloading action of the real firearms. This design not only improves shooting simulation, but also improves the user experience, especially for those who pursue a realistic shooting experience, this improvement is highly attractive.

Additional features and advantages of the present invention will be set forth in the description which follows, and in part will be obvious from the description, or may be learned by implementing the present invention. The objectives and other advantages of the present invention may be realized and obtained by a structure particularly pointed out in the written specification and drawings.

BRIEF DESCRIPTION OF THE DRAWINGS

The present invention will be described in detail below with reference to the drawings, so as to make the above advantages of the present invention more clear.

DETAILED DESCRIPTION OF THE EMBODIMENTS

Figure 1:
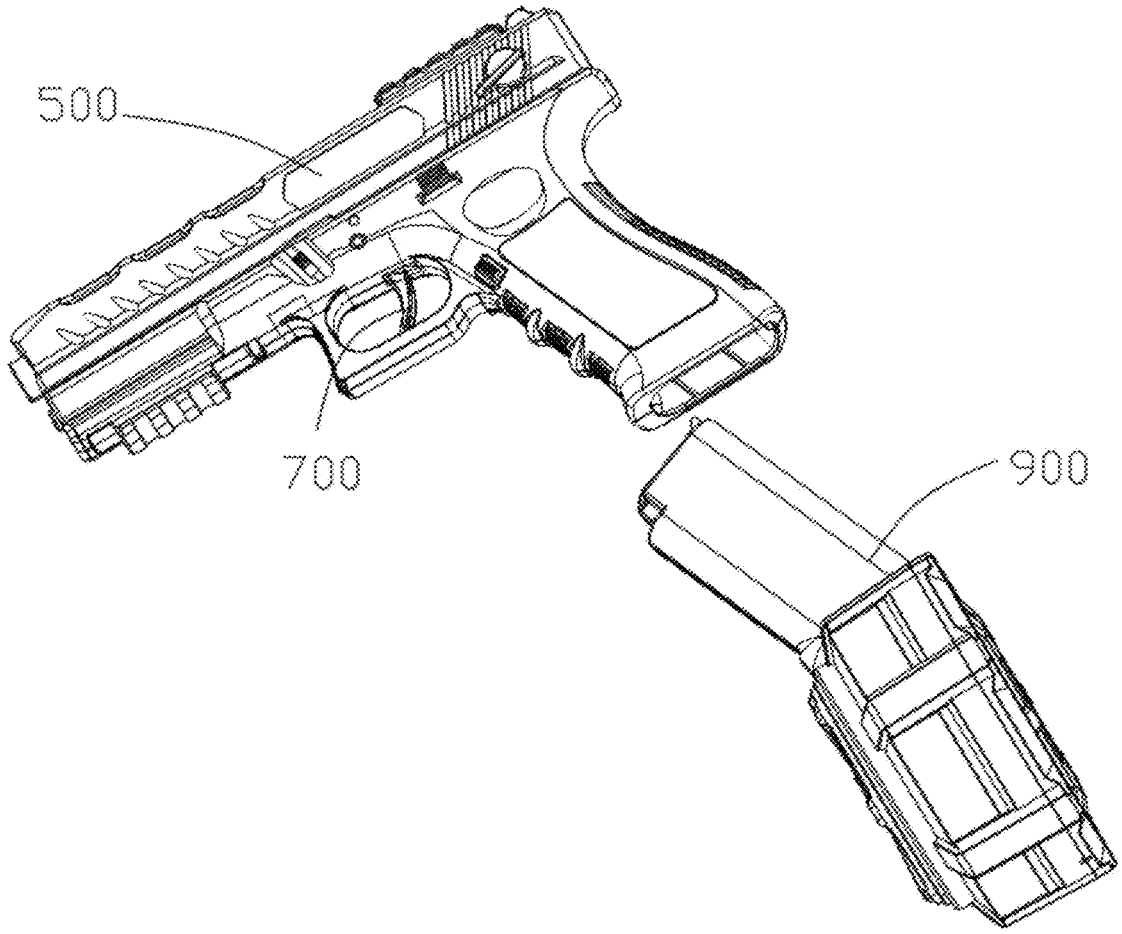
FIG. 1 is a schematic diagram of a toy gun according to the present invention.

Embodiments of the present invention are described in detail below and examples of the embodiments are shown in the accompanying drawings, where the same or similar reference signs always represent the same or similar elements or elements with the same or similar functions. The embodiments described below with reference to the accompanying drawings are exemplary, and are intended to explain the present invention, but shall not be understood as a limitation on the present invention.

In the description of the present invention, it should be noted that, the orientations or positional relationships indicated by the terms "length", "width", "up", "down", "front", "back", "left", "right", "vertical", "horizontal", "top", "bottom", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention.

Furthermore, the terms "first" and "second" are intended only for descriptive purposes and should not be construed as indicating or implying their relative importance or implying the quantity of technical features indicated. Therefore, a feature limited by "first" or "second" may explicitly or implicitly include one or more features. In the description of the present invention, the meaning of "plurality" is at least two, unless otherwise specifically defined.

In the embodiments of the present invention, unless otherwise expressly specified and defined, the terms "mounted", "attached", "connected", "fixed", etc. should be understood in a broad sense, for example, a connection may be a fixed connection, a detachable connection, or an integral connection; it may be a mechanical connection or an electrical connection; it may be a direct connection or an indirect connection via an intermediate medium; and it may be a connection between two elements or an interaction between two elements. For those of ordinary skill in the art, the specific meanings of the above terms in the present invention can be understood on a case-by-case basis.

Referring to FIGS. 1-13, a toy gun, including:

- a gun body support 100, where a gun barrel 110 communicating with a chamber, and a pellet supplying pipeline 120 communicating with a pellet clip bin and the chamber are arranged on the gun body support 100;
- a piston assembly 200 slidably mounted on the gun body support 100, where a firing spring 130 is arranged between the piston assembly 200 and the gun body support 100, and the firing spring 130 is used for, through elastic force, driving the piston assembly 200 to generate compressed gas to fire pellets;
- a motor 400, where the motor 400, through a gear set, drives the piston assembly 200 to slide to compress the firing spring 130;
- a power supply electrically connected to the motor 400 and used for supplying electricity; and
- a sliding member 500 where the sliding member 500 is slidably mounted on the gun body support 100;
- where a first unloading bump 210 is arranged on the piston assembly 200, a second unloading bump 510 is arranged on the sliding member 500, the second unloading bump 510 is located behind the first unloading bump 210, when the motor 400 drives the piston assembly 200 to compress backwards the firing spring 130, the first unloading bump 210 generates interference with the second unloading bump 510 and drives the sliding member 500 to slide backwards.

The design purpose of the toy gun is to enhance the simulation effect while maintaining the basic functions of a water pellet gun, especially to improve the shooting experience of users by imitating the unloading action of real firearms. In order to achieve the purpose, the designer adds structures such as the sliding member 500 and unloading bumps on the basis of the structure of a traditional water pellet gun, such that in the shooting process, not only can water pellets be fired, but also recoil and the unloading action similar to those of the real firearms can be generated, thereby increasing the simulation degree of the toy gun.

When the user pulls the trigger 700, the motor 400 starts working and, through the gear set, drives the piston assembly 200 to slide backwards. During the backward movement, the piston assembly 200 compresses the firing spring 130 until the firing spring reaches the maximum compression position. After the firing spring 130 is fully compressed, accumulated elastic force pushes the piston assembly 200 back forwards, and the water pellets are pushed by the generated compressed gas into the gun barrel 110 and shot out, thereby achieving the shooting function. In the process of moving the piston assembly 200 backwards to compress the spring, the first unloading bump 210 on the piston assembly 200 generates interference with the second unloading bump 510 on the sliding member 500. Due to the second unloading bump 510 being located behind the first unloading bump 210, such interference will push the sliding member 500 backwards, thereby enabling the sliding member 500 to simulate the retreating action of the sliding sleeve of the real firearms, and increasing the simulation degree.

By designing the sliding member 500 and the unloading bumps, the unloading action of the real firearms is successfully simulated, allowing the water pellet gun to not only fire pellets but also visually and operationally resemble the real firearms. This design significantly enhances the playability of the toy and the immersion of users. By designing the sliding member 500 and the bumps reasonably without significantly increasing structural complexity, a complex unloading action is achieved. This not only maintains control on production costs, but also increases the functionality of the toys. As the water pellet gun, soft water pellets are still used, such that safety is high. Even with the addition of the unloading action, the safety of the toy is still ensured, such that the toy is suitable for use by children and teenagers. The motor 400, through the gear set, drives the piston assembly 200 to slide to compress the spring, thereby simplifying user operations while ensuring stability and shooting rate of continuous shooting, and further enhancing the user experience.

In the embodiments, a reset spring is arranged between the sliding member 500 and a front end of the gun body support 100, which is used for resetting the sliding member 500 that moves backwards. The design of the reset spring is introduced, with the aim of automatically resetting the sliding member 500 to the initial position after the action of backward movement is finished. This design further enhances the simulation degree of the water pellet gun, making not only the shooting process more realistic, but also the entire operation cycle closer to that of the real firearms. By adding the reset spring, the problem that the sliding member 500 cannot automatically reset after completing the backward movement action is solved, thereby simplifying the user operations and improving the user experience of the toy gun. When the sliding member 500 is pushed to the farthest end, the reset spring is compressed, thereby storing elastic potential energy. After the backward movement action of the sliding member 500 is finished, the elastic force of the reset spring will be released, thereby pushing the sliding member 500 forwards back to the initial position. The reset action makes the motion of sliding member 500 closer to the operations of the sliding sleeve of the real firearms, further enhancing the simulation effect of shooting. After the sliding member 500 is reset, the piston assembly 200 also completes forward movement under the action of the firing spring 130, and the entire system returns to the initial state, thereby preparing for the next shooting. The cycle process is smooth and efficient, thereby ensuring the smoothness of the toy gun during continuous shooting.

Referring to FIGS. 1-5, in the embodiments, the piston assembly 200 includes an outer sleeve 220 and a piston push rod 230, one end of the outer sleeve 220 is sleeved outside the piston push rod 230, an air cavity is formed between the outer sleeve 220 and the piston push rod 230, an air outlet 221 communicating with the air cavity is formed in the other end of the outer sleeve, and the piston push rod 230 is in sliding connection to the outer sleeve 220;

the gear set includes a multiple-stage gear 410 and a plurality of transmission gears, first gear teeth 420 and second gear teeth 430 are arranged on the multiple-stage gear 410, and a radius of the first gear teeth 420 is smaller than that of the second gear teeth 430; and a rack portion is arranged on the surface of the outer sleeve 220 and the surface of the piston push rod 230, the first gear teeth 420 are engaged with the outer sleeve 220, the second gear teeth 430 are engaged with the piston push rod 230, and the first gear teeth 420 and the second gear teeth 430 are in partial circular array, such that the multiple-stage gear 410 is indirectly engaged with the outer sleeve 220 and the piston push rod 230.

Through coordinated movement of the outer sleeve 220 and the piston push rod 230, and through precise control of the set of the multiple-stage gear 410, automatic loading of the water pellets, compression of the firing spring 130, and final shooting of the water pellets are achieved. This design aims to optimize the continuous shooting performance of the water pellet gun, and smooth execution of each step in each shooting cycle is ensured through clever mechanical design, thereby improving shooting efficiency and shooting accuracy.

When the motor 400 continues to operate, the first gear teeth 420 of the set of the multiple-stage gear 410 are engaged with the outer sleeve 220 to push the outer sleeve 220 to move backwards. Backward movement of the outer sleeve 220 makes space for the loading of the water pellets, thereby allowing the water pellets to enter the chamber smoothly. Besides, the second gear teeth 430 of the set of the multiple-stage gear 410 are engaged with the piston push rod 230 to push the piston push rod 230 to move backwards, thereby compressing the firing spring 130 to accumulate energy for the next shooting.

When the set of the multiple-stage gear 410 rotates to a position where the outer sleeve 220 and the piston push rod 230 are no longer engaged, the compressed firing spring 130 releases the elastic force to push the outer sleeve 220 and the piston push rod 230 forwards to reset. In the reset process, the outer sleeve 220 pushes the loaded water pellets into the gun barrel 110. Besides, the reset of the piston push rod 230, through the air cavity, generates compressed gas, thereby pushing the water pellets to shoot out at a high speed to complete the shooting. This process repeats continuously, forming a cycle of continuous shooting.

Through precise control on the outer sleeve 220 and the piston push rod 230 by the set of the multiple-stage gear 410, the steps of pellet feeding, compressing the spring, pushing the pellets into the gun barrel, shooting through compressed gas, etc. during each shooting cycle can be smoothly linked, achieving efficient continuous shooting. Users can experience smooth operations and stable shooting performance. The outer sleeve 220 moves backwards to provide sufficient space for the loading of the water pellets, and pushes the water pellets into the gun barrel 110 when resetting, so as to ensure that the water pellets are correctly positioned before each shooting. The piston push rod 230 moves backwards to provide compression energy for the firing spring 130, to ensure sufficient power support for each shooting, resulting in stable and powerful shooting effects. Despite introduction of multiple components such as the set of the multiple-stage gear 410, the outer sleeve 220, and the piston push rod 230, the overall structural design still maintains simple and compact. Through clever cooperation between these components, the complex shooting process is completed, thereby ensuring high performance and reliability of the toy gun. The design of the set of the multiple-stage gear 410 and the piston assembly 200 is subjected to precise calculations, thereby ensuring coordinated operation between various components, reducing the possibility of jamming and failure, and improving overall durability and long-term reliability.

Figure 4:
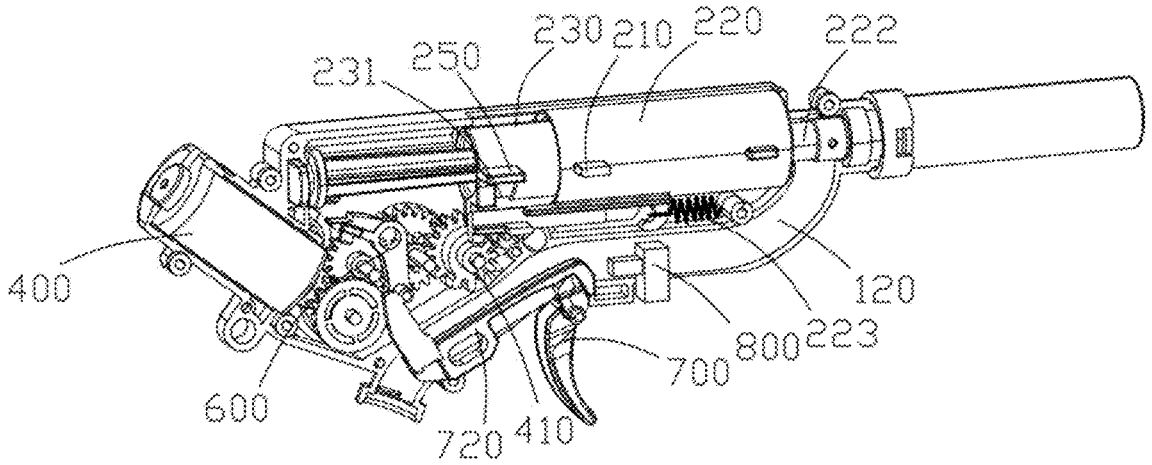
FIG. 4 is an internal schematic diagram of a gun body support of a toy gun according to the present invention.
Figure 5:
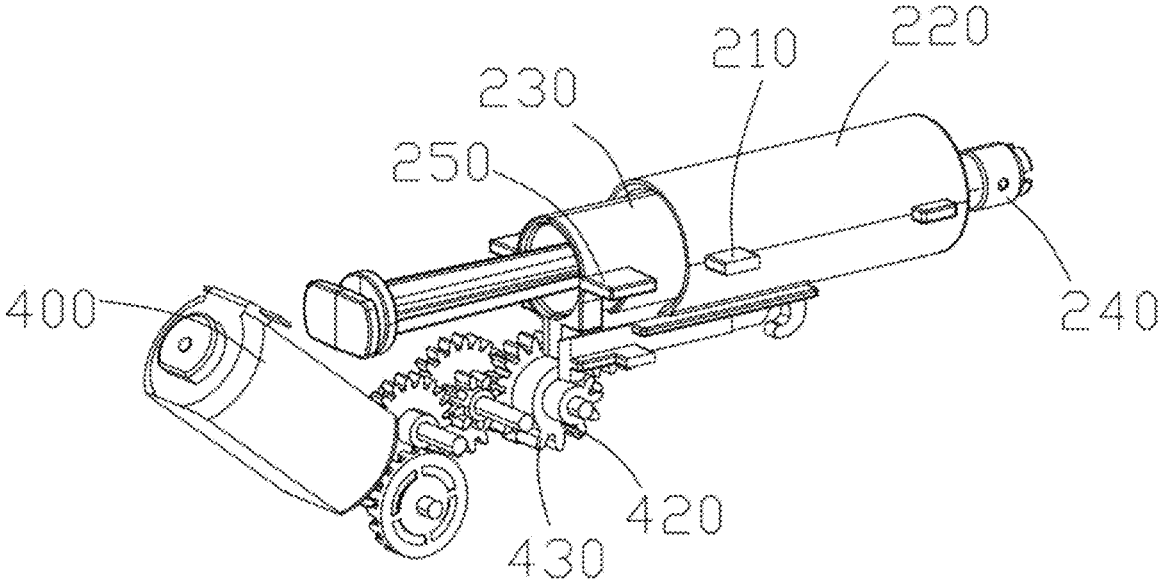
FIG. 5 is a schematic diagram of a transmission structure of a toy gun according to the present invention.

Referring to FIG. 4, in the embodiments, an outer sleeve reset tension spring 223 is arranged between the outer sleeve 220 and the gun body support 100, such that the outer sleeve 220 can automatically and quickly reset after completing backward movement action. The core of this design concept is to use elastic force of the reset tension spring to pull the outer sleeve 220 back to the initial position after each backward movement, thereby preparing for the next shooting cycle. The addition of the outer sleeve reset tension spring 223 not only improves the operation efficiency of the outer sleeve 220, but also enhances smoothness and automation of the overall shooting process.

When sliding backwards, the outer sleeve 220 will complete the action of loading or supplying the pellets, whether through manual operation or driving by the motor 400. After completing these actions, the outer sleeve 220 needs to quickly return to the initial position to prepare for the next shooting.

The outer sleeve reset tension spring 223 is mounted between the outer sleeve 220 and the gun body support 100. When the outer sleeve 220 moves backwards, the outer sleeve reset tension spring 223 is stretched to accumulate elastic force. After the outer sleeve 220 completes backward movement action, the outer sleeve reset tension spring 223 releases the elastic force, to quickly pull the outer sleeve 220 back to the initial position.

The function of the outer sleeve reset tension spring 223 enables a reset process of the outer sleeve 220 to be fully automated, without need for manual intervention by the user. This not only simplifies operation steps, but also ensures that the outer sleeve 220 can return to the initial position in the shortest time, reducing shooting interval time.

The outer sleeve 220 quickly resets under the action of the reset tension spring, which means that after each shooting, the outer sleeve 220 can immediately prepare for the next pellet supply and shooting. This design effectively guarantees continuity of the shooting cycle, making rapid and continuous shooting possible.

Figure 2:
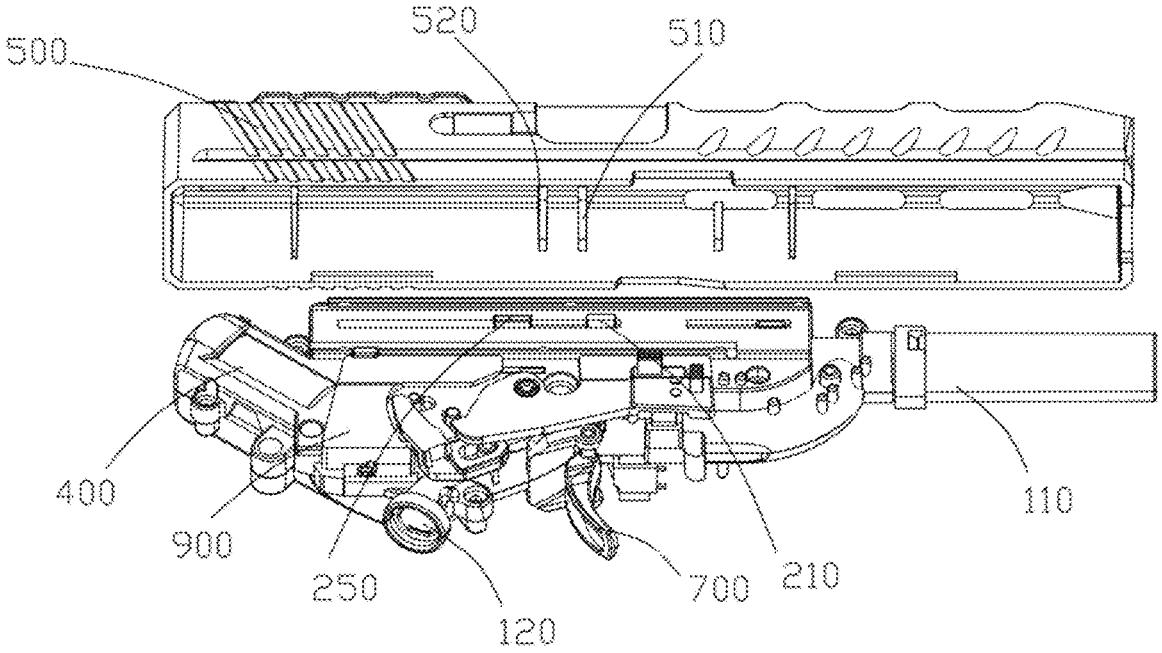
FIG. 2 is a schematic diagram of a sliding member of the toy gun in an assembling direction according to the present invention.
Figure 3:
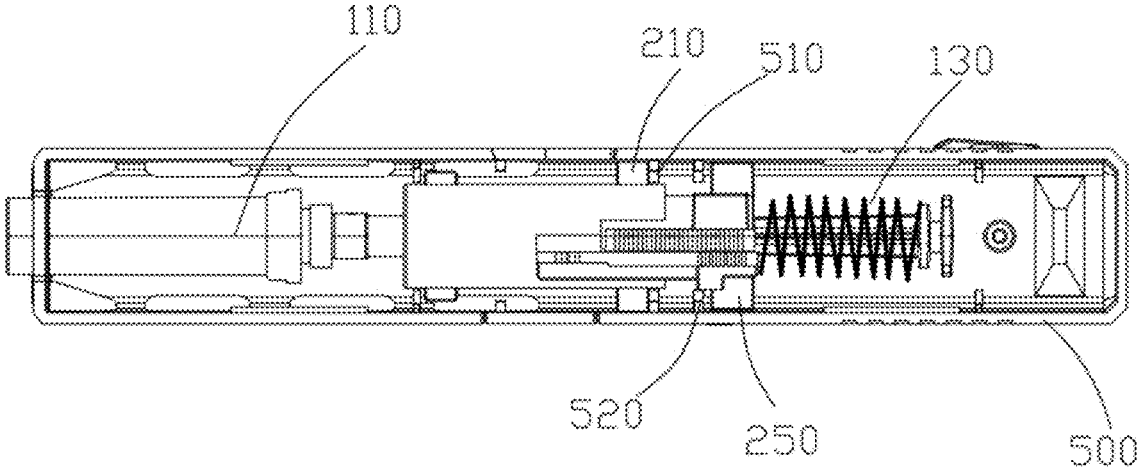
FIG. 3 is an internal schematic diagram of a sliding member of a toy gun according to the present invention.

Referring to FIGS. 2-3, in the embodiments, the first unloading bump 210 is located on the surface of the outer sleeve 220. Different functions and motion requirements of the outer sleeve 220 and the piston push rod 230 are taken into full consideration, and the first unloading bump 210 is arranged on the surface of the outer sleeve 220 through reasonable structural configuration. The purpose of this design is to simulate the unloading action by utilizing a shorter retreating distance of the outer sleeve 220, without using the piston push rod 230 to drive the sliding member 500 to retreat. Doing so has the advantage that the pellet feeding function can be achieved while maintaining authenticity and consistency of the unloading action.

The outer sleeve 220 has the main function of providing space for the loading of the water pellets. When the motor 400 drives the gear set to rotate and the first gear teeth 420 are engaged with a rack portion of the outer sleeve 220, the outer sleeve 220 moves backwards to make enough space to enable the water pellets to enter the chamber smoothly. Due to the shorter retreating distance of the outer sleeve 220, this motion can simulate the unloading action of the real firearms well. The piston push rod 230 moves backwards under the action of the second gear teeth 430. As the piston push rod 230 needs to generate effective air compression to push the water pellets to shoot out, the retreating distance is relatively long. However, this long-distance retreating is not suitable for driving the sliding member 500 to simulate unloading. Therefore, the retreating action of the sliding member 500 is only completed by short-distance motion of the outer sleeve 220.

Figure 6:
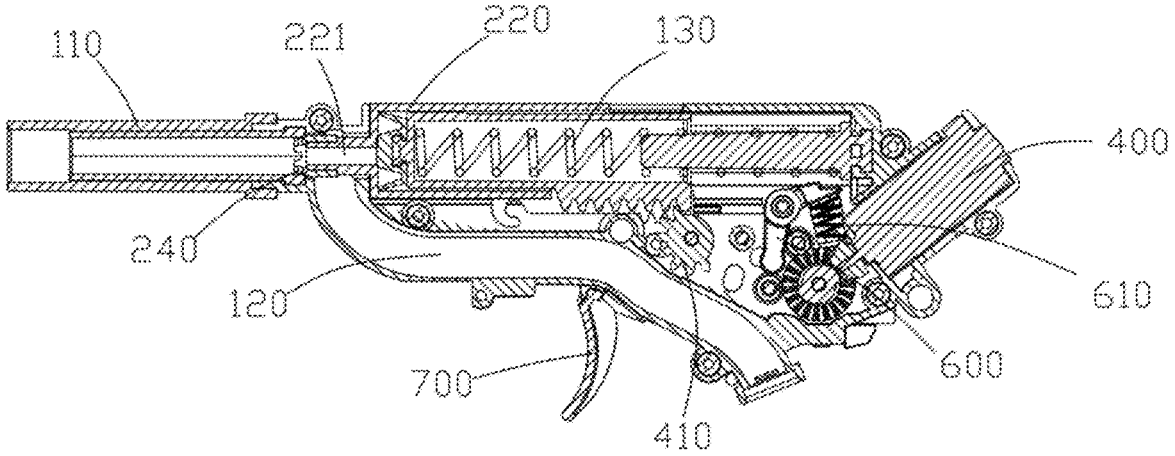
FIG. 6 is a sectional view of the gun body support of a toy gun according to the present invention.
Figure 7:
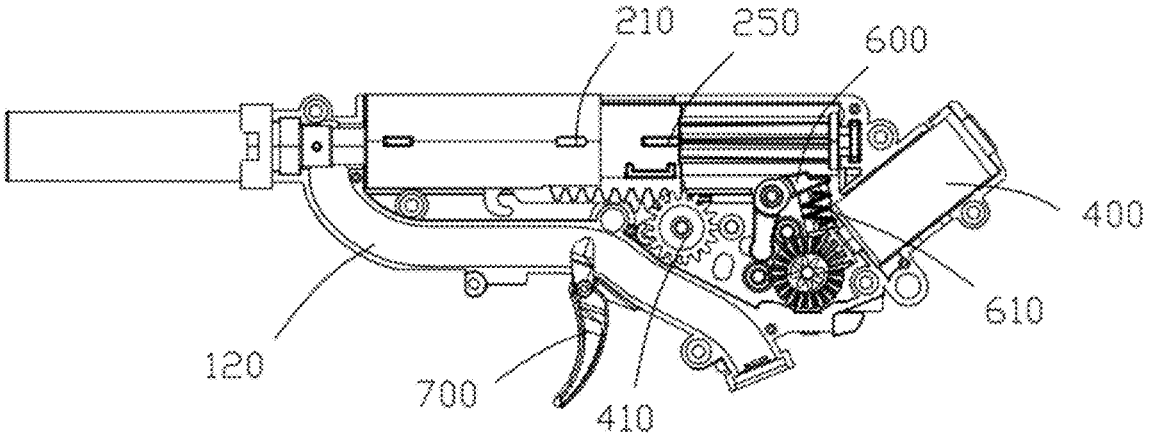
FIG. 7 is a schematic diagram of an internal structure of a gun body support of a toy gun according to the present invention.

Referring to FIG. 6, in the embodiments, the air outlet 221 extends outwards to form a pellet pushing bump 222; and pellet pushing flexible glue 240 is arranged at an end head of the pellet pushing bump 222, where the pellet pushing bump 222 is used for pushing the pellets in the chamber into the gun barrel 110, and when the pellet pushing bump 222 pushes the pellets into the gun barrel 110, the pellet pushing flexible glue 240 and the gun barrel 110 form seal.

The pellet pushing bump 222 is arranged at the extension of the air outlet 221, and the pellet pushing flexible glue 240 is additionally arranged at the end head of the pellet pushing bump 222, such that the problem that the water pellets may break in the process of being pushed into the gun barrel 110, while ensuring effective seal during firing and maximizing the use of energy of the compressed gas. This design aims to improve the shooting stability of the water pellet gun, and transfer efficiency of shooting energy, and besides, protect the water pellets from being damaged.

When the piston assembly 200 moves forwards, the pellet pushing bump 222 extends from the air outlet 221 to the chamber, thereby pushing the water pellets from the chamber into the gun barrel 110. In the process, the pellet pushing flexible glue 240 arranged at the end head of the pellet pushing bump 222 is in contact with the water pellets. Due to soft nature, the pellet pushing flexible glue 240 can effectively absorb impact force during pushing the pellets, thereby preventing the water pellets from being broken due to uneven stress when being pushed into the gun barrel 110.

The pellet pushing flexible glue 240 and an inner wall of the gun barrel 110 form tight seal when the water pellets are pushed by the pellet pushing bump 222 into the gun barrel 110. When the piston assembly 200 completes reset and generates the compressed gas, this sealing structure can ensure that the gas does not leak, thereby enabling the energy during firing to intensively act on the water pellets, ensuring that the water pellets can be stably shot out at a high speed.

The design of the pellet pushing flexible glue 240 is a key innovation point of the embodiment. By providing a soft contact surface for the water pellets during pellet pushing, the pellet pushing flexible glue 240 effectively reduces the breaking risk of the water pellets in the process of being pushed into the gun barrel 110. This not only improves a success rate of shooting, but also reduces cleaning work caused by the breaking of the water pellets, thereby enhancing the overall user experience. The tight contact between the pellet pushing flexible glue 240 and the gun barrel 110 forms a good seal effect. This seal can prevent the compressed gas from leaking during firing, ensuring that the firing energy can be intensively transmitted to the water pellets, thereby improving the power and range of shooting. Through the coordinated effect of the pellet pushing bump 222 and the pellet pushing flexible glue 240, the entire shooting process becomes more efficient. The water pellets can be smoothly pushed into the gun barrel 110, and the energy during firing is maximized. This design not only improves the efficiency of single shooting, but also makes continuous shooting more stable.

Referring to FIGS. 2-6, in the embodiments, the first loading bump 250 is arranged on the piston push rod 230, and the second loading bump 520 is arranged on the sliding member 500; and the second loading bump 520 is located in front of the first loading bump 250, and when the user slides the sliding member 500 backwards, the second loading bump 520 generates interference with the first loading bump 250 and drives the piston push rod 230 to compress backwards the firing spring 130. The core idea is to provide the user with two operation modes: an electric operation mode and a manual operation mode. The first loading bump 250 is arranged on the piston push rod 230, and the second loading bump 520 is arranged on the sliding member 500, such that the user can complete the actions of loading and compressing the firing spring 130 through manually operating the sliding member 500 without using the motor 400 for driving. This design not only improves flexibility and playability of the toy gun, but also enables the user to continue using the toy gun for shooting when a battery runs low or the user wants to save electricity.

When the user chooses not to use the motor 400 to drive the toy gun, the sliding member 500 can be manually pulled. The second loading bump 520 on the sliding member 500 is located in front of the first loading bump 250, and when the sliding member 500 slides backwards, the second loading bump 520 generates interference with the first loading bump 250 and pushes the piston push rod 230 to move backwards.

The piston push rod 230 moves backwards to gradually compress the firing spring 130, to accumulate energy for the next shooting.

Due to the design of the multiple-stage gear 410, the piston push rod 230 will retreat in conjunction with the outer sleeve 220 in the process of moving backwards. The retreating action of the outer sleeve 220 provides space for the loading of the water pellets, thereby allowing the water pellets to enter the chamber smoothly.

When the user releases the sliding member 500, the compressed firing spring 130 pushes the piston push rod 230 and the outer sleeve 220 to reset, the outer sleeve 220 rebounds to push the water pellets into the gun barrel 110, and the piston push rod 230, through the compressed gas, fires the water pellets.

This design allows the user to switch between the manual mode and the electric mode according to needs. In the manual mode, by pulling the sliding member 500, not only is the spring compressed, but also loading and shooting preparations are completed. In the electric mode, the motor 400 drives the set of multiple-stage gear 410 to complete the same action. The user can save electricity or meet different shooting needs by switching the operation modes.

By adding a manual operation option, the user can not only use an electric continuous shooting mode, but also choose manual operations for single shooting. This multi-functional operation mode enhances flexibility and playability of the toy gun, adapting to the needs of different users and different usage scenarios. Even when the battery runs low, the users can still use the toy gun through the manual operations without being limited by the battery. This is particularly practical when the toy gun is used for a long time or when the battery is not replaced in a timely manner, improving the practical usability of the toy gun. Due to the presence of the multiple-stage gear 410, when the piston push rod 230 retreats, the outer sleeve 220 also synchronously retreats, ensuring smooth completion of the loading process. This linkage design simplifies operation steps, making it easy for the users to complete loading and shooting preparations, whether in the manual mode or the electric mode. By adding a manual operation option, the users can more directly participate in a shooting preparation process, enhancing the sense of interaction and operation. For users who enjoy simulating operations of the real firearms, this manual operation design is more attractive.

Referring to FIGS. 4-7, in the embodiments, a piston lock 600 is hinged in the gun body support 100, and a locking spring 610 is arranged between the piston lock 600 and the gun body support 100 so as to ensure that the piston lock 600 can reset after being stressed;

the piston lock 600 is located behind the piston push rod 230, and a locking slot 231 of which the position corresponds to that of the piston lock 600 is formed in the piston push rod 230, where when the piston push rod 230 moves backwards, the locking slot 231 of the piston push rod 230 generates interference with the piston lock 600, and the piston lock 600 avoids temporarily under the action of pushing force to allow the piston push rod 230 to pass through; and after the piston push rod 230 completely passes through the piston lock 600, the locking spring 610 pushes the piston lock 600 to reset to an initial position to be clamped into the locking slot 231 of the piston push rod 230, and the piston push rod 230 is locked at a position after backward movement.

Regarding the situation of manual loading, during manual loading, the piston push rod 230 is fixed at the position after backward movement through the piston lock 600, thereby ensuring that the piston push rod 230 can be stably maintained at the predetermined position, and waiting for the user to pull the trigger 700 to complete the shooting. This design aims to improve convenience and safety of the manual operations, and ensure a stable and reliable to-be-fired state after the manual loading.

When the user manually pulls the sliding member 500, the piston push rod 230 moves backwards to compress the firing spring 130. During the backward movement of the piston push rod 230, the locking slot 231 in the piston push rod 230 gradually approaches the position of the piston lock 600. When the locking slot 231 and the piston lock 600 are aligned, the piston lock 600 avoids temporarily under the action of pushing force to enable the piston push rod 230 to continue moving backwards. Once the piston push rod 230 completely passes through the piston lock 600, the locking spring 610 pushes the piston lock 600 to reset, the piston lock 600 is clamped into the locking slot 231 of the piston push rod 230, and the piston push rod 230 is fixed at a position after backward movement. After manual loading, the piston push rod 230 is firmly locked by the piston lock 600, and the entire system enters a stable to-be-fired state. At this time, the piston push rod 230 remains at the position of compressing the firing spring 130, waiting for the user to pull the trigger 700 to complete shooting. When the user pulls the trigger 700, the piston lock 600 unlocks the piston push rod 230, the firing spring 130 releases pressure to push the piston push rod 230 to move forwards, and ultimately the shooting of the water pellets is completed through the compressed gas.

The piston lock 600 is specifically designed for the manual loading, ensuring that the piston push rod 230 can be stably locked at the position after backward movement in the manual loading process. This function prevents the piston push rod 230 from accidentally sliding after the manual loading, improving the safety of the manual operations. After the manual loading, the piston push rod 230 is locked by the piston lock 600, and the entire system enters a safe to-be-fired state. The automatic reset function of the piston lock 600 makes the operations after the manual loading more convenient for the user. The user does not need to manually lock the piston push rod 230. The piston lock 600 can automatically clamp the piston push rod 230 at the appropriate position, ensuring that the piston push rod is fixed at the correct position. Aiming or adjustment is performed before shooting, without worrying about accidental movement of the piston push rod 230 or shooting errors. This design is specifically optimized for the manual loading, ensuring that the user can still enjoy a stable and reliable shooting preparation process without relying on driving by the motor 400. This function specifically designed for the manual operations enhances flexibility and practicality of the toy gun.

In the embodiments, a sliding stroke in which the motor 400, through the second gear teeth 430, drives the piston push rod 230 is a first stroke distance;

a stroke in which the sliding member 500, through the second loading bump 520, enables the piston push rod 230 to cooperate with the piston lock 600 is a second stroke distance; and the first stroke distance is smaller than the second stroke distance.

By setting the first stroke distance of the sliding stroke of the piston push rod 230 driven by the motor 400 to be shorter than the second stroke distance of a manual loading stroke, the piston push rod 230 can perform continuous reciprocating motion without interference from the piston lock 600 in the continuous shooting mode driven by the motor 400. This design enables the piston lock 600 to only function during the manual loading, but not to affect continuity and smoothness of the shooting in the electric mode.

In the continuous shooting mode driven by the motor 400, a stroke in which the motor 400, through the second gear teeth 430, drives the piston push rod 230 to slide is the first stroke distance. The stroke distance is set too short to enable the locking slot 231 of the piston push rod 230 to be in contact with the piston lock 600, therefore, in the entire electric shooting process, the piston lock 600 will not participate in the motion of the push rod. The design of the multiple-stage gear 410 enables the piston push rod 230 to perform high-speed reciprocating motion within the first stroke distance, ensuring smoothness and stability during continuous shooting.

When the user chooses the manual loading, a stroke in which the sliding member 500, through the second loading bump 520, pushes the piston push rod 230 to move backwards to slide is the second stroke distance. The stroke distance is longer than the first stroke distance in the electric mode, which enables the locking slot 231 of the piston push rod 230 to be in contact with the piston lock 600. In the manual loading process, the piston push rod 230 is locked by the piston lock 600, ensuring that the piston push rod remains stable at the position after backward movement and waits for the trigger 700 to be fired to complete the shooting.

Because the first stroke distance is smaller than the second stroke distance, a short stroke in the electric mode ensures that the piston push rod 230 can perform continuous reciprocating motion without interference from the piston lock 600. This design logic enables the piston lock 600 to function specifically for the manual loading, without affecting continuity of shooting in the electric mode.

The first stroke distance driven by the motor 400 is relatively short, enabling the piston push rod 230 to perform continuous reciprocating motion without being in contact with the piston lock 600. This design ensures shooting smoothness in the electric mode, without interruption or delay caused by intervention of the piston lock 600. Through differentiated design of the stroke distances, the users can flexibly switch between the electric mode and the manual mode. In the manual mode, the piston lock 600 can ensure stability of the piston push rod 230, while in the electric mode, the piston lock 600 does not affect continuity of the shooting process. The precise design of the stroke distances enables each operation mode to operate at the optimal state. The short stroke in the electric mode ensures efficient continuous shooting, while the long stroke in the manual mode provides reliable loading and shooting preparations. This optimized design enhances the overall operating experience of the users.

Figure 8:
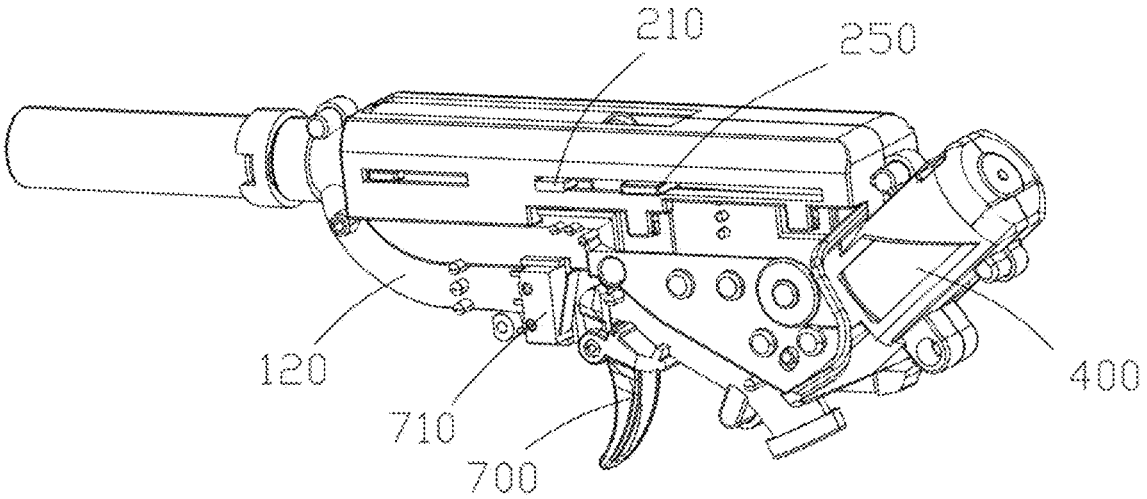
FIG. 8 is a schematic diagram of mounting of a micro switch of a toy gun according to the present invention.
Figure 9:
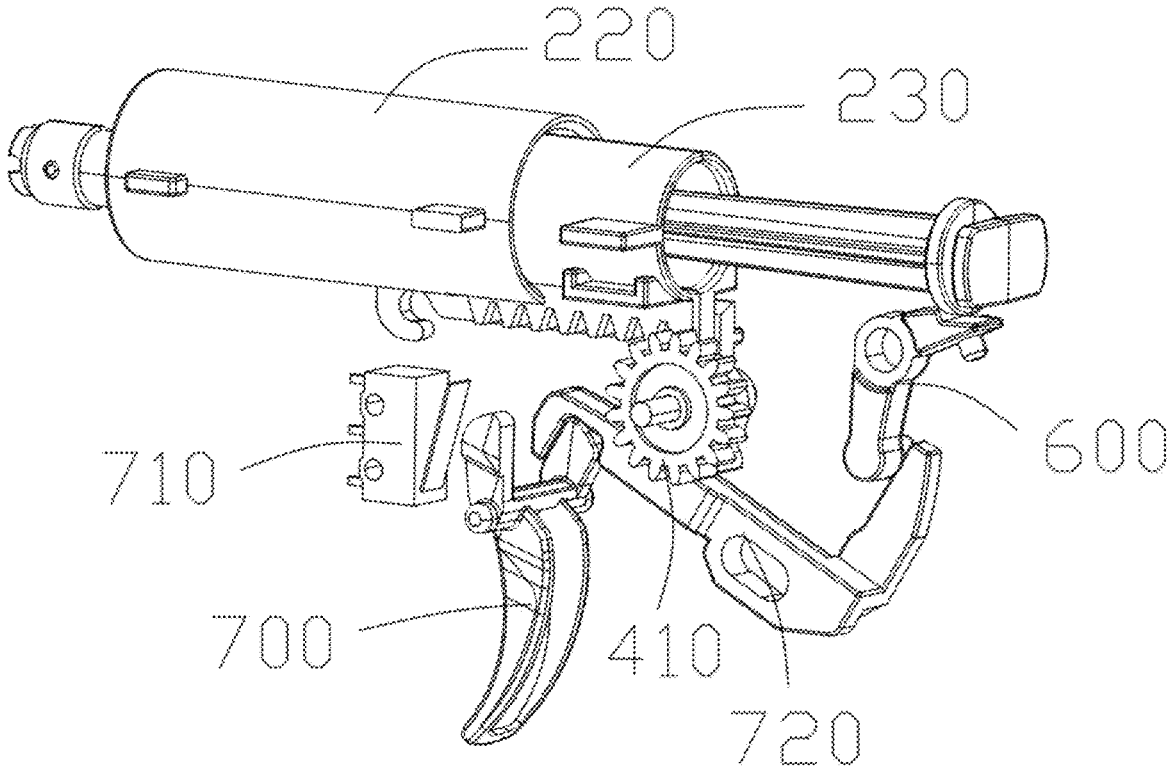
FIG. 9 is a schematic diagram of assembly of a trigger of a toy gun according to the present invention.
Figure 10:
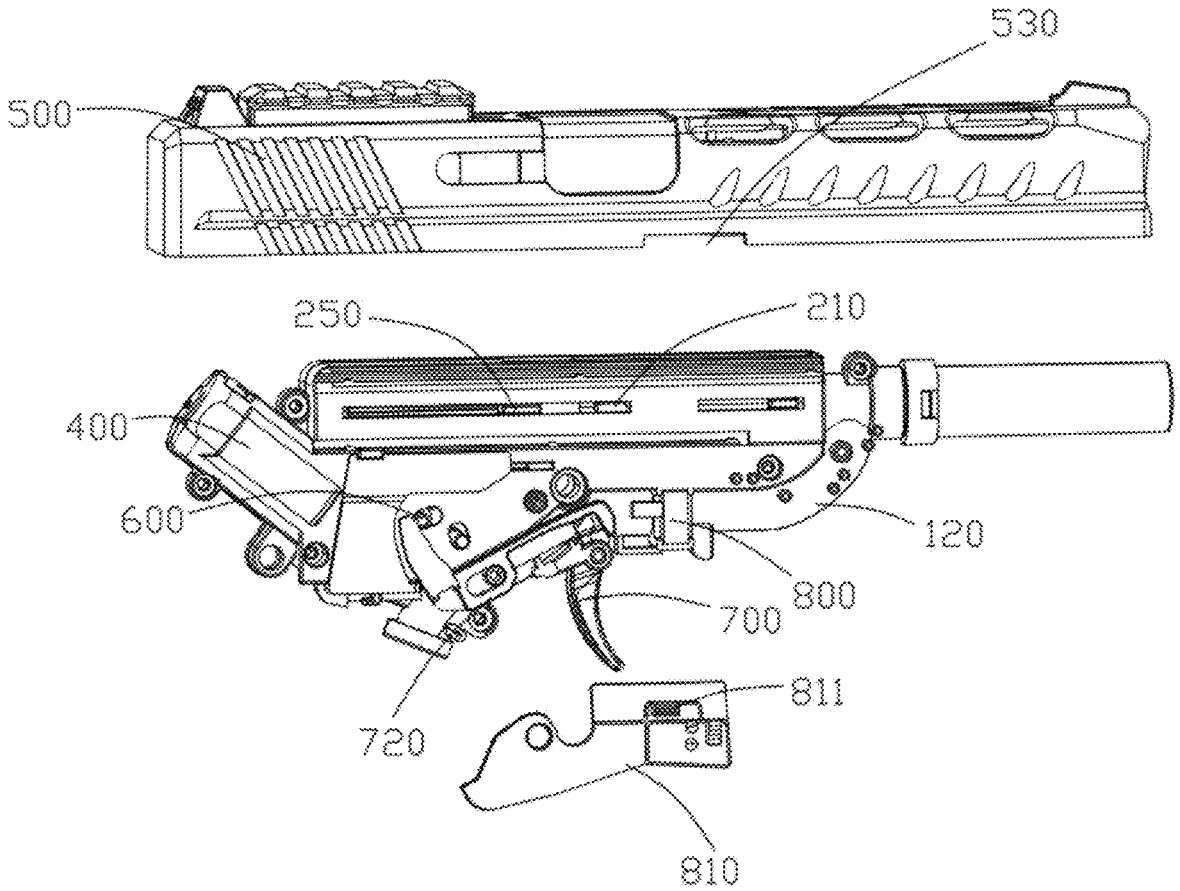
FIG. 10 is a schematic diagram of positional relationship of a gear sliding block of a toy gun according to the present invention.
Figure 11:
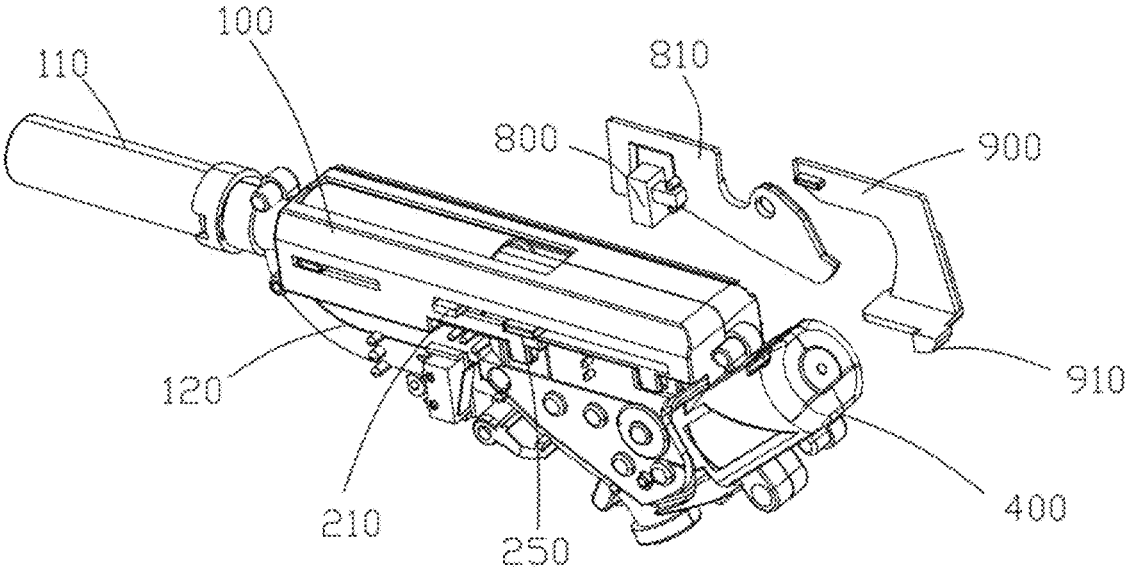
FIG. 11 is an exploded view of a structure of a gear sliding block of a toy gun according to the present invention.
Figure 12:
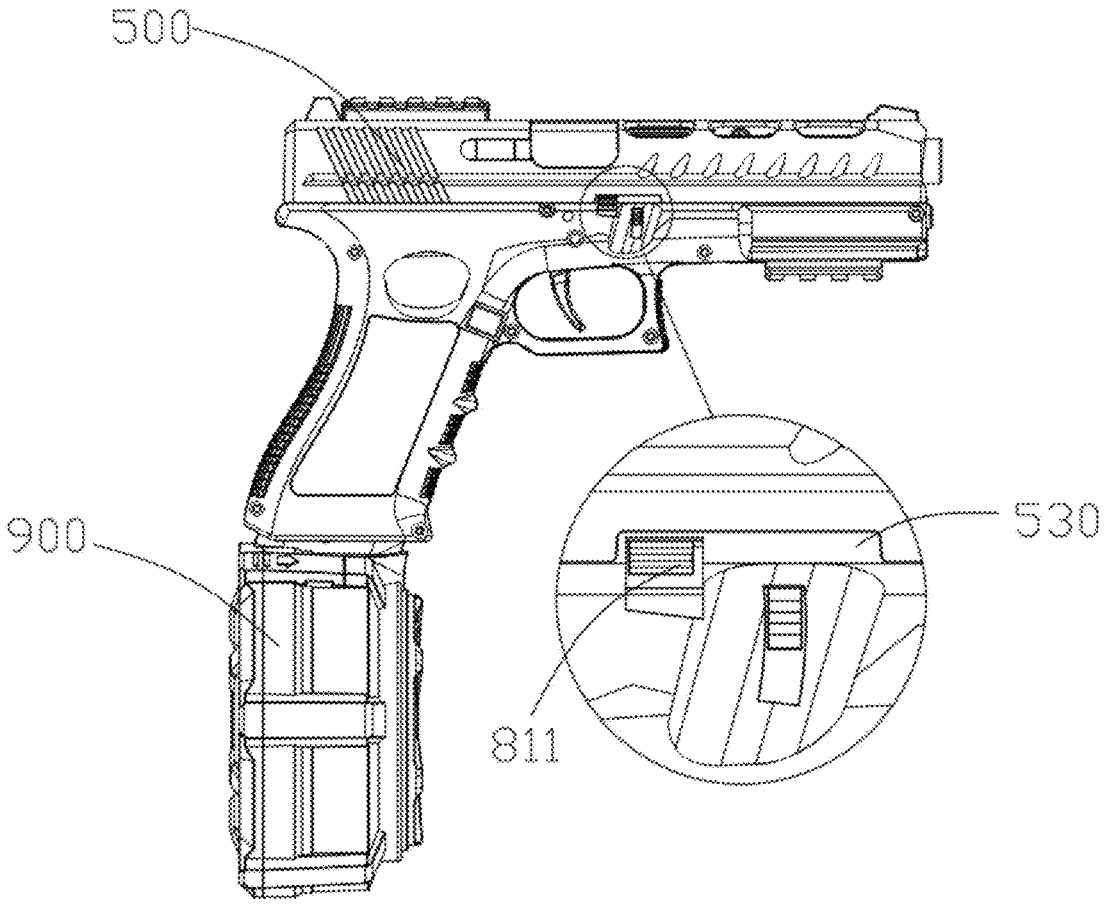
FIG. 12 is a schematic diagram of assembly of a limiting bump of a toy gun according to the present invention.
Figure 13:
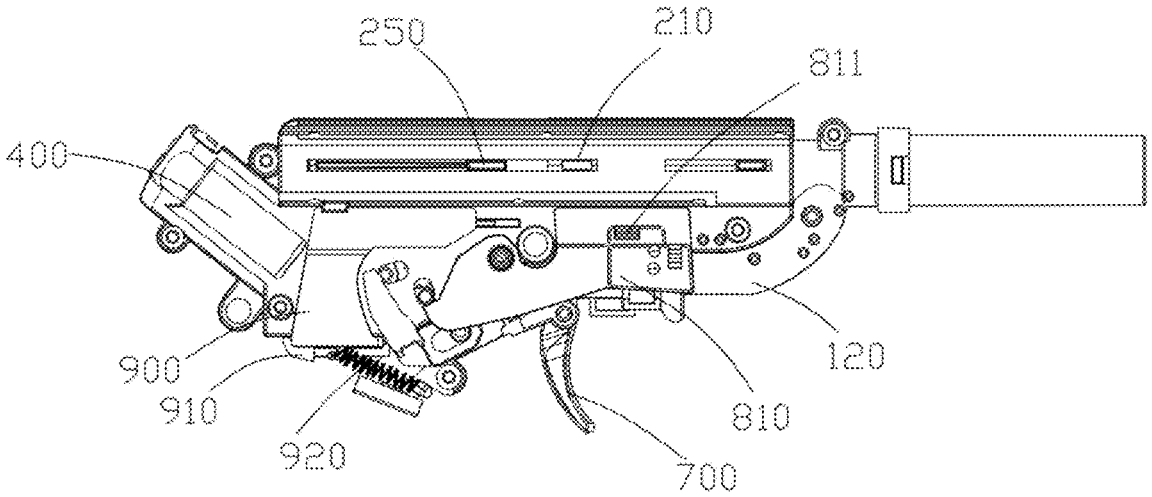
FIG. 13 is a schematic diagram of assembly of a pellet supplying sliding block of a toy gun according to the present invention.

Referring to FIGS. 8-9, in the embodiments, a trigger 700 is hinged to the gun body support 100, and a micro switch 710 and a trigger bar 720 are arranged on two sides of the trigger 700 respectively;

the micro switch 710 is arranged on an electric loop of the motor 400, and when the trigger 700 rotates, the trigger 700 generates interference with the micro switch 710 to enable the micro switch 710 to be switched on; and two ends of the trigger bar 720 are abutted against the trigger 700 and the piston lock 600 respectively, and when the trigger 700 rotates, the trigger 700, through the trigger bar 720, drives the piston lock 600 to be away from the piston push rod 230.

Through mechanical and electrical linkage of the trigger 700, dual control for starting the motor 400 and unlocking the piston lock 600 is achieved. When the user pulls the trigger 700, not only can the motor 400 be started through the micro switch 710 to drive the piston push rod 230 for shooting, but also the piston lock 600 can be unlocked through the trigger bar 720 to release the locked piston push rod 230. This design combines the advantages of mechanical and electrical control, ensuring the reliability of the shooting process and the smoothness of the operations.

The trigger 700 is hinged to the gun body support 100, and the micro switch 710 and the trigger bar 720 are arranged on two sides of the trigger 700 respectively. When the user pulls the trigger 700, the trigger 700 rotates and generates interference with the micro switch 710 to enable the micro switch 710 to be switched on. The micro switch 710 is switched on to enable the electric loop of the motor 400 to be connected, and the motor 400 begins to operate to drive the piston push rod 230 to perform the shooting operations.

One end of the trigger bar 720 is connected to the trigger 700, and the other end is abutted against the piston lock 600. When the user pulls the trigger 700, the trigger bar 720 rotates to push the piston lock 600 away from the piston push rod 230. After the piston lock 600 is away from the piston push rod 230, the piston push rod 230 is unlocked from the locking slot 231, the compression energy of the firing spring 130 is released, and the piston push rod 230 is pushed to move forwards, such that the shooting is completed.

When the trigger 700 is pulled, both electrical control and mechanical control take effect simultaneously. The micro switch 710 is switched on to start the motor 400, and the motor 400 drives the piston push rod 230 for shooting; and besides, the piston lock 600 is unlocked through the trigger bar 720 to release the piston push rod 230, ensuring smooth execution of the shooting action. This design makes the entire shooting process more coherent and reliable.

The design cleverly combines the electrical control and the mechanical control, enabling the start of the motor 400 and the unlocking of the piston lock 600 simultaneously through the operations of the trigger 700. The integrated design simplifies operations of the users and improves the smoothness of the shooting process. Through a dual-control mechanism, the operations of the motor 400 and the piston lock 600 can be precisely synchronized, ensuring smooth completion of each shooting. Whether in the electric mode or the manual mode, this design provides stable and reliable shooting experience.

Referring to FIGS. 10-13, in the embodiments, the toy gun further includes a gear switch 800, where the gear switch 800 is arranged on an electric loop of the motor 400. By adding the gear switch 800, the control accuracy of starting the motor 400 and the flexibility of the operations of the user can be enhanced. The gear switch 800 is integrated into the electric loop of the motor 400 as an additional control point for the circuit. Only when the gear switch 800 is switched on, the micro switch 710 triggered by pulling the trigger 700 can start the motor 400 to achieve the shooting operations. This design ensures the safety of the toy gun in specific modes, and gives the user a choice for shooting modes.

The gear switch 800 is arranged in the electric loop of the motor 400 as a prerequisite for controlling start of the motor 400. When the gear switch 800 is switched on, the electric loop of the motor 400 is connected, allowing the motor 400 to start and drive the piston push rod 230 to perform the shooting operations after receiving a signal of the micro switch 710.

On the contrary, if the gear switch 800 is switched off, even if the trigger 700 triggers the micro switch 710, the electric loop of the motor 400 is still in a disconnected state, and the motor 400 will not work, thereby preventing a shooting behavior from occurring.

The gear switch 800 provides additional safety protection for the toy gun. Only when the gear switch 800 is switched on, the motor 400 can be started after the micro switch 710 is pulled by the trigger 700. This design effectively prevents accidental starting of the motor 400 and reduces the risk of misoperations.

In the embodiments, the toy gun further includes a gear sliding block 810, where the gear sliding block 810 is slidably arranged on the gun body support 100 to be abutted against the gear switch 800;

a limiting bump 811 is arranged on the gear sliding block 810, and a limiting slot 530 is formed in a lower edge of the sliding member 500; and when the gear sliding block 810 controls the gear switch 800 to be switched off, the limiting bump 811 is separated from the limiting slot 530, and when the gear sliding block 810 controls the gear switch 800 to be switched on, the limiting bump 811 is located in the limiting slot 530 to be used for limiting the sliding stroke of the sliding member 500. By adding the gear sliding block 810 and a limiting device, the problem of collision between the piston push rod 230 and the multiple-stage gear 410 that may occur in the electric mode is solved. By controlling the movement of the gear sliding block 810, whether the gear switch 800 is switched on or not is controlled, thereby limiting the stroke for the manual loading, and avoiding mechanical interference and collision caused by stroke differences during the manual loading in the electric mode. This design logic ensures the safety and operation consistency of the toy gun in the electric mode.

The gear sliding block 810 is arranged on the gun body support 100 to be abutted against the gear switch 800 mutually. When the user slides the gear sliding block 810, the gear switch 800 can be controlled to be switched on or switched off. When the gear sliding block 810 controls the gear switch 800 to be switched on, the toy gun enters the electric mode, and at the same time, the motor 400 can be started to drive the piston push rod 230 to perform the shooting operations. The limiting bump 811 is arranged on the gear sliding block 810, and the limiting slot 530 is formed in the lower edge of the sliding member 500. When the gear sliding block 810 controls the gear switch 800 to be switched off, the limiting bump 811 is separated from the limiting slot 530, allowing the sliding member 500 to slide freely, which is suitable for the manual loading operations. When the gear sliding block 810 controls the gear switch 800 to be switched on, the limiting bump 811 is engaged with the limiting slot 530, the sliding stroke of the sliding member 500 is limited, and the sliding member 500 is prevented from performing the manual loading. This can avoid the situation where in the electric mode, the manual loading causes the piston push rod 230 to exceed the first stroke distance in the electric mode, resulting in interference with the multiple-stage gear 410.

Due to the short first stroke distance of the piston push rod 230 in the electric mode, if the piston push rod 230 is pushed to the second stroke distance through manual loading, collision between the piston push rod 230 and the multiple-stage gear 410 may be caused. Through the design of the limiting device, the stroke of the sliding member 500 is limited in the electric mode, and the stroke is prevented from exceeding the limit during the manual loading, thereby avoiding mechanical interference and possible damage.

In the embodiments, the toy gun further includes a pellet supplying sliding block 900 slidably mounted on the gun body support 100, where the pellet supplying sliding block 900 is located behind the outer sleeve 220, and the pellet supplying sliding block 900 extends to the pellet clip bin to form a pellet supplying bump 910; and when moving backwards, the outer sleeve 220 generates interference with the pellet supplying sliding block 900 and drives the pellet supplying sliding block 900 to slide backwards, and the pellet supplying bump 910 is used for driving a pellet clip 300 to supply pellets.

By designing a linkage mechanism between the pellet supplying sliding block 900 and the outer sleeve 220, the pellet supplying process of the toy gun is optimized. When the outer sleeve 220 slides backwards, the pellet supplying sliding block 900 is synchronously driven to move, thereby triggering the pellet clip 300 to supply the pellets. This design makes a pellet supplying process more automated and smooth, ensuring that the pellet feeding action before each shooting can be completed in a timely manner, improving continuity and reliability of shooting.

When sliding backwards, the outer sleeve 220 generates mechanical interference with the pellet supplying sliding block 900 located behind the outer sleeve. This interference drives the pellet supplying sliding block 900 to slide backwards while causing the outer sleeve 220 to move backwards.

The pellet supplying sliding block 900 will, through the pellet supplying bump 910, be in contact with the pellet clip 300 in the backward movement process, pushing the pellets in the pellet clip 300 into the pellet supplying pipeline 120, thereby completing the pellet feeding operations.

The pellet supplying sliding block 900 is designed to be slidably mounted on the gun body support 100, and extends to the pellet clip bin to form the pellet supplying bump 910. The motion of the outer sleeve 220 directly affects the motion of the pellet supplying sliding block 900, enabling the pellet supplying sliding block 900 to move backwards synchronously when the outer sleeve 220 moves backwards, thereby ensuring that the pellet supplying action is consistent with the motion of the outer sleeve 220. The pellet supplying bump 910 is in contact with the pellet clip 300 in the sliding process, and the pellets in the pellet clip 300 are driven to enter the pellet supplying pipeline 120, thereby preparing for the next shooting.

The pellet supplying process becomes more automated through the linkage between the outer sleeve 220 and the pellet supplying sliding block 900. Every time the outer sleeve 220 moves backwards, the pellet supplying sliding block 900 will synchronously trigger the pellet clip 300 for supplying the pellets, thereby ensuring that the pellets can enter the gun chamber smoothly. This design avoids tedious operations of the manual pellet feeding, and improves continuity and smoothness of shooting.

The linkage design between the pellet supplying sliding block 900 and the outer sleeve 220 enables the pellet feeding action before each shooting to be automatically completed, reducing the number of operation steps of the user and improving the automation level of the toy gun. The automatic pellet supplying mechanism ensures that the pellets can enter the gun chamber in a timely manner during rapid continuous firing, avoiding pellet supplying delays. Through synchronous motion of the outer sleeve 220 and the pellet supplying sliding block 900, the pellet supplying process and the shooting action are seamlessly linked. This not only improves shooting efficiency, but also reduces the situation of pellet jamming or poor pellet supply, ensuring the smoothness of the shooting process.

In the embodiments, a pellet supplying reset tension spring 920 is arranged between the pellet supplying sliding block 900 and the gun body support 100. The pellet supplying reset tension spring 920 is arranged between the pellet supplying sliding block 900 and the gun body support 100, it is ensured that the pellet supplying sliding block 900 can quickly reset to the initial position after completing the pellet supplying action. The effect of the pellet supplying reset tension spring 920 is to use the elastic force to enable the pellet supplying sliding block 900 to automatically return to the initial position after completing the pellet supplying operations each time, thereby preparing for the next pellet supply. When moving backwards, the outer sleeve 220 generates interference with the pellet supplying sliding block 900, and pushes the pellet supplying sliding block 900 to slide backwards. During backward movement of the pellet supplying sliding block 900, the pellet supplying bump 910 pushes the pellets in the pellet clip 300 into the pellet supplying pipeline 120, and finally the pellets enter the chamber, thereby completing the pellet feeding action. After the pellet supplying sliding block 900 completes the pellet supplying action, the pellet supplying reset tension spring 920 is stretched to accumulate elastic force. When the outer sleeve 220 no longer interferes with the pellet supplying sliding block 900, the elastic force of the reset tension spring quickly pulls the pellet supplying sliding block 900 back to the initial position. The pellet supplying sliding block 900 resets to prepare for the next pellet supplying action, ensuring that the pellet supplying sliding block 900 can smoothly complete the pellet supplying operations again when the outer sleeve 220 moves backwards next time.

Through the effect of the pellet supplying reset tension spring 920, the pellet supplying sliding block 900 can automatically and continuously complete the pellet supplying action and the reset action. This automated pellet supplying cycle ensures continuity and stability of the shooting process, and can effectively prevent untimely or delayed pellet supply especially in the continuous shooting mode. The pellet supplying sliding block 900 is mounted on the outer side of the gun body support 100, and a chute is formed in the surface of the gun body support 100, such that interference between the pellet supplying sliding block 900 and the piston assembly 200 can be avoided. Both the outer sleeve 220 and the pellet supplying sliding block 900 are provided with sliding blocks located within the chute. Through this design, the pellet supplying sliding block 900 and the outer sleeve 220 can move smoothly on their respective tracks, independently and without interference with each other. The design concept aims to optimize the operations of a pellet supplying system while ensuring normal operations of the piston assembly 200.

In the embodiments, in order to avoid interfering with the operations of the piston assembly 200, the pellet supplying sliding block 900 is mounted on the outer side of the gun body support 100. The chute is formed in the surface of the gun body support 100, and both the outer sleeve 220 and the pellet supplying sliding block 900 are provided with the sliding blocks located in the chute.

Figure 14:
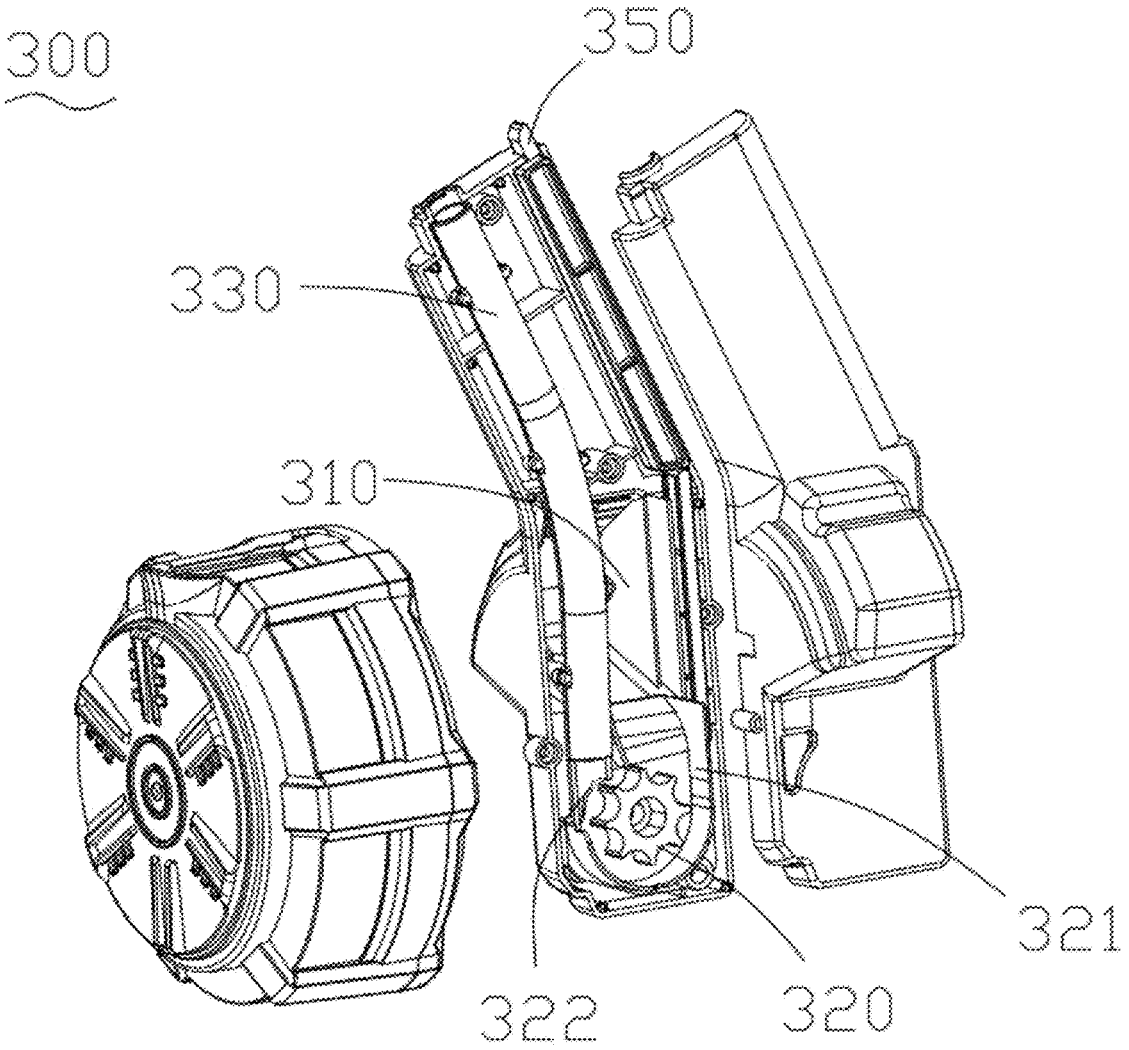
FIG. 14 is a schematic diagram of assembly of a rotating wheel of a pellet clip of a toy gun according to the present invention.
Figure 15:
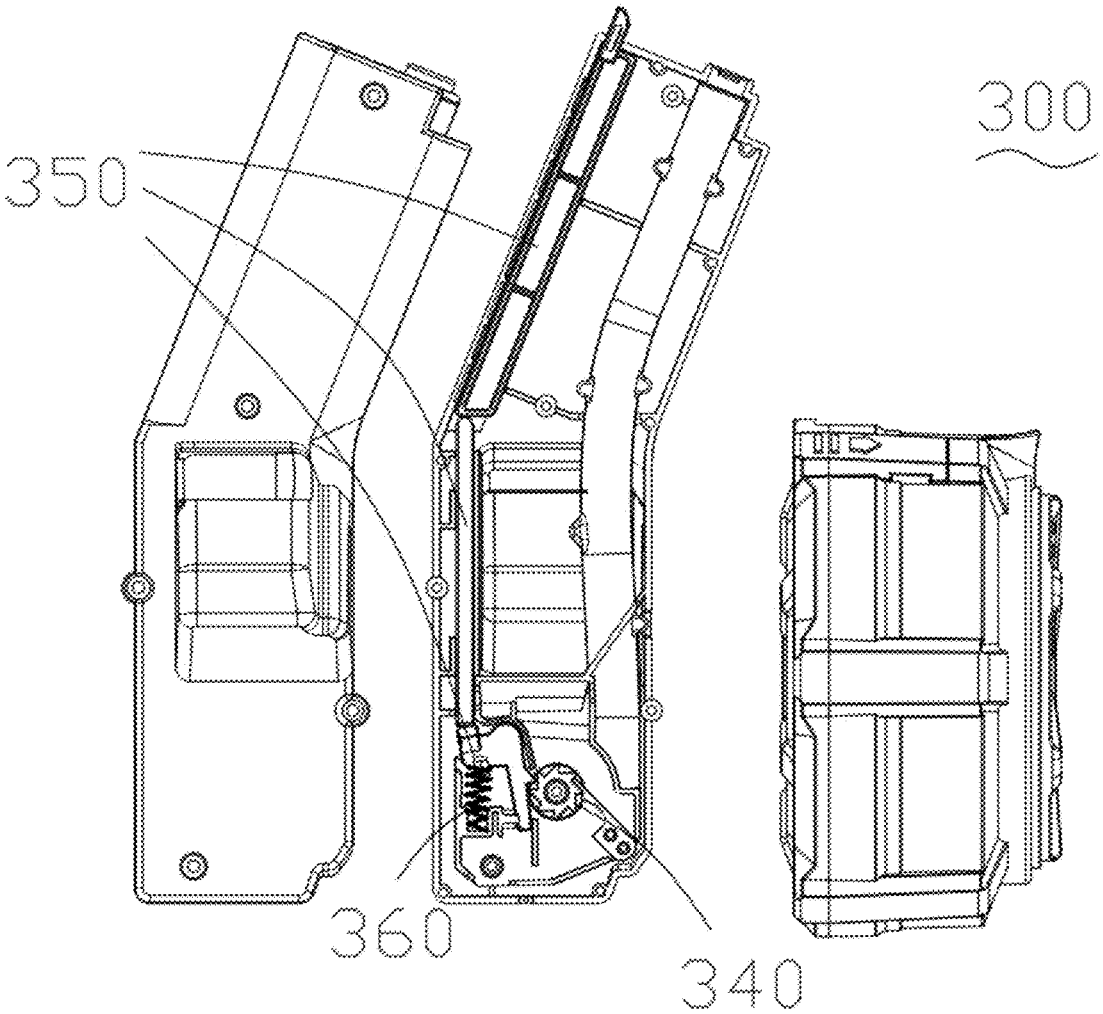
FIG. 15 is a schematic diagram of assembly of a bar assembly of a pellet clip of a toy gun according to the present invention.

In the embodiments, the pellet clip 300 is detachably mounted in the pellet clip bin, and the pellet clip 300 includes:

referring to FIGS. 14-15, a pellet bin 310 used for accommodating the pellets, where a rotating wheel 320 is arranged at a bottom end of the pellet bin 310;

the rotating wheel 320 mounted at the bottom end of the pellet bin 310, where a pellet supplying gap is formed between the rotating wheel and the bottom end of the pellet bin 310, and grooves for accommodating the pellets are formed in the edge of the rotating wheel 320; and a pellet pipeline 330, where one end of the pellet pipeline 330 communicates with the pellet supplying pipeline 120, the other end of the pellet pipeline extends to the rotating wheel 320, one side of the rotating wheel 320, that is close to the pellet bin 310, is a pellet inlet 321, one side of the rotating wheel 320, that is close to the pellet pipeline 330, is a pellet supplying opening 322, and when the rotating wheel 320 rotates, the grooves are used for transferring the pellets of the pellet bin 310 to the pellet pipeline 330.

The rotating wheel 320 is arranged at the bottom end of the pellet clip 300, thereby realizing smooth pellet supply. The core idea of the design is to use the rotation of the rotating wheel 320 to transfer the pellets in the pellet bin 310 one by one to the pellet pipeline 330, so as to achieve automated pellet supply. Through the design of the detachable pellet clip 300, the user can conveniently replace or replenish the pellets, thereby enhancing practicality and convenience of the toy gun.

The pellet bin 310 of the pellet clip 300 is used for accommodating the pellets, and the rotating wheel 320 is mounted at the bottom end of the pellet bin. The rotating wheel 320 is located at the bottom end of the pellet bin 310, and the pellet supplying gap is formed between the rotating wheel and the pellet bin 310 to ensure that the pellets can smoothly enter the pellet supplying channel from the pellet bin 310.

The grooves for accommodating the pellets are formed in the edge of the rotating wheel 320. When the rotating wheel 320 rotates, these grooves pick up the pellets in the pellet bin 310 one by one from the pellet inlet 321 and transfer the pellets to the pellet supplying opening 322. Through this process, the pellets can be automatically transferred from the pellet bin 310 to the pellet pipeline 330.

One end of the pellet pipeline 330 is connected to the pellet supplying pipeline 120, and the other end of the pellet pipeline extends to the rotating wheel 320, thereby ensuring that the pellets transferred by the rotating wheel 320 can smoothly enter the pellet pipeline 330. This design ensures continuity and stability of the pellets in the pellet supplying process, avoiding pellet jamming or poor pellet supply.

When the rotating wheel 320 rotates, the pellets in the grooves are transferred one by one to the pellet pipeline 330, and finally enter the pellet supplying channel and prepare for shooting. The design of the rotating wheel 320 makes the pellet supplying process highly automated, and the user can achieve continuous pellet supply without manual intervention, adapting to the needs of rapid shooting.

Through the design of the rotating wheel 320, different shooting requirements for a low speed to a high speed can be achieved. Whether for single shooting or continuous shooting, the rotating wheel 320 can provide stable pellet supply and adapt to different shooting rhythms.

In the embodiments, the rotating wheel 320 is provided with a notch wheel 340 which is concentric therewith and located outside the pellet bin 310;

a bar assembly 350 is slidably arranged in the pellet clip 300, one end of the bar assembly 350 extends to a top end of the pellet clip 300, and the other end of the bar assembly extends to the notch wheel 340; and a pawl for driving the notch wheel 340 to rotate is arranged at a bottom end of the bar assembly 350, the pellet supplying bump 910 is provided with a bevel for driving the bar assembly 350 to perform downward compressing, and when the pellet supplying bump 910 of the pellet supplying sliding block 900 generates interference with the bar assembly 350 and drives the bar assembly 350 to slide downwards, the pawl drives the notch wheel 340 to rotate.

By introducing the linkage mechanism between the notch wheel 340 and the bar assembly 350, precise pellet supply and automatic loading of the pellets are achieved. The rotating wheel 320 and the notch wheel 340 are designed to be concentric and driven to rotate by the bar assembly 350. By interference between the pellet supplying bump 910 of the pellet supplying sliding block 900 and the bar assembly 350, it is ensured that each time the sliding blocks move, the bar assembly 350 can be driven to enable the notch wheel 340 to rotate, thereby achieving the sequential supply of the pellets. The core of the design is to automatically fill the pellet pipeline 330 and achieve the pellet feeding action before each shooting through precise control.

When the user uses the toy gun for the first time, the rotating wheel 320 rotates under the drive of the notch wheel 340, to transport the pellets in the pellet bin 310 one by one to the pellet pipeline 330. As the rotating wheel 320 rotates, the pellets gradually fill the pellet pipeline 330 and the pellet supplying channel in the gun body support 100. After the pellet pipeline 330 and the pellet supplying channel are filled with the pellets, the next pellets will, through the rotating wheel 320, continue to be fed into the chamber, thereby completing the pellet feeding operations.

The notch wheel 340 is located outside the pellet bin 310 and is concentric with the rotating wheel 320. The bar assembly 350 in the pellet clip 300 is slidably mounted, one end of the bar assembly 350 extends to a top end of the pellet clip 300, and the other end of the bar assembly extends to the notch wheel 340. When the pellet supplying bump 910 of the pellet supplying sliding block 900 generates interference with the bar assembly 350, the bar assembly 350 is pressed downwards, and the pawl at the bottom end of the bar assembly 350 is driven to enable the notch wheel 340 to rotate. The notch wheel 340 rotates to further drive the rotating wheel 320 to transport the pellets one by one to the pellet pipeline 330.

Driven by the rotating wheel 320, each time one pellet is transported into the pellet pipeline 330, one pellet will be squeezed into the chamber at the other end of the pellet supplying channel, completing the pellet feeding action. This design ensures that one pellet is accurately pushed into the chamber before each shooting, preparing for shooting. With each movement of the pellet supplying sliding block 900, the notch wheel 340 rotates by a certain angle, pushing the rotating wheel 320 to supply the pellets next time. This design ensures high automation in the supplying and loading process of the pellets, reducing the complexity of operations of the user while ensuring smooth firing each time.

In the embodiments, a bar reset spring 360 is arranged at the bottom end of the bar assembly 350. The bar reset spring 360 is arranged at the bottom end of the bar assembly 350, such that it is ensured that the bar assembly 350 can quickly reset to the initial position after driving the notch wheel 340 to rotate each time. The effect of the bar reset spring 360 is to use the elastic force to enable the bar assembly 350 to automatically return to the initial position after completing actions, thereby preparing for the next pellet supplying operation. This design aims to improve working efficiency and stability of the bar assembly 350, ensuring reliability of the pellet supplying system during continuous shooting.

One end of the bar assembly 350 extends to the top end of the pellet clip 300, and the other end of the bar assembly extends to the notch wheel 340. When the pellet supplying bump 910 of the pellet supplying sliding block 900 generates interference with the bar assembly 350, the bar assembly 350 is driven to move downwards, the pawl at the bottom end of the bar assembly pushes the notch wheel 340 to rotate, and further the rotating wheel 320 is driven to supply the pellets. After the pellet supplying action is completed, the bar reset spring 360, through the elastic force, quickly pulls the bar assembly 350 back to the initial position, ensuring that the bar assembly 350 prepares for the next pellet supplying operation. The bar reset spring 360 is mounted at the bottom end of the bar assembly 350. After the bar assembly 350 completes the pellet supplying action, the bar assembly 350 quickly returns to the initial position through the elastic force of the spring. The spring not only ensures quick reset of the bar assembly 350, but also avoids the stagnation or failure of the pellet supplying system caused by the bar assembly 350 staying at a downward pressing position. Through the automatic reset function of the bar reset spring 360, the bar assembly 350 can quickly prepare for the next operation after each pellet supplying action. This design ensures continuity of the pellet supplying system, and especially in high-frequency shooting mode, ensures timely supply of the pellets before each shooting.

Finally, it should be noted that the foregoing descriptions are merely preferred embodiments of the present invention, but are not intended to limit the present invention. Although the present invention has been described in detail with reference to the foregoing embodiments, those skilled in the art will readily appreciate that they can make modifications to technical solutions recorded in the embodiments described herein, or make equivalent replacements of some of the features described herein. Any modifications, equivalent replacements, improvements, and the like made within the spirit and principle of the present invention shall fall within the protection scope of the present invention.

What is claimed is:

1. A toy gun, comprising:

a gun body support (100), wherein a gun barrel (110) communicating with a chamber, and a pellet supplying pipeline (120) communicating with a pellet clip bin and the chamber are arranged on the gun body support (100);

a piston assembly (200) slidably mounted on the gun body support (100), wherein a firing spring (130) is arranged between the piston assembly (200) and the gun body support (100), and the firing spring (130) is used for, through elastic force, driving the piston assembly (200) to generate compressed gas to fire pellets;

a motor (400), wherein the motor (400), through a gear set, drives the piston assembly (200) to slide to compress the firing spring (130);

a power supply electrically connected to the motor (400) and used for supplying electricity; and a sliding member (500), wherein the sliding member (500) is slidably mounted on the gun body support (100), wherein a first unloading bump (210) is arranged on the piston assembly (200), a second unloading bump (510) is arranged on the sliding member (500), the second unloading bump (510) is located behind the first unloading bump (210), when the motor (400) drives the piston assembly (200) to compress backwards the firing spring (130), the first unloading bump (210) generates interference with the second unloading bump (510) and drives the sliding member (500) to slide backwards.

2. The toy gun according to claim 1, wherein the piston assembly (200) comprises an outer sleeve (220) and a piston push rod (230), one end of the outer sleeve (220) is sleeved outside the piston push rod (230), an air cavity is formed between the outer sleeve (220) and the piston push rod (230), an air outlet (221) communicating with the air cavity is formed in the other end of the outer sleeve, and the piston push rod (230) is in sliding connection to the outer sleeve (220);

the gear set comprises a multiple-stage gear (410) and a plurality of transmission gears, first gear teeth (420) and second gear teeth (430) are arranged on the multiple-stage gear (410), and a radius of the first gear teeth (420) is smaller than that of the second gear teeth (430); and a rack portion is arranged on the surface of the outer sleeve (220) and the surface of the piston push rod (230), the first gear teeth (420) are engaged with the outer sleeve (220), the second gear teeth (430) are engaged with the piston push rod (230), and the first gear teeth (420) and the second gear teeth (430) are in partial circular array, such that the multiple-stage gear (410) is indirectly engaged with the outer sleeve (220) and the piston push rod (230).

3. The toy gun according to claim 2, wherein the first unloading bump (210) is located on the surface of the outer sleeve (220).

4. The toy gun according to claim 2, wherein the air outlet (221) extends outwards to form a pellet pushing bump (222);

pellet pushing flexible glue (240) is arranged at an end head of the pellet pushing bump (222); and the pellet pushing bump (222) is used for pushing pellets in the chamber into the gun barrel (110), and when the pellet pushing bump (222) pushes the pellets into the gun barrel (110), the pellet pushing flexible glue (240) and the gun barrel (110) form seal.

5. The toy gun according to claim 2, wherein a first loading bump (250) is arranged on the piston push rod (230), and a second loading bump (520) is arranged on the sliding member (500); and the second loading bump (520) is located in front of the first loading bump (250), and when a user slides the sliding member (500) backwards, the second loading bump (520) generates interference with the first loading bump (250) and drives the piston push rod (230) to compress backwards the firing spring (130).

6. The toy gun according to claim 5, wherein a piston lock (600) is hinged in the gun body support (100), and a locking spring (610) is arranged between the piston lock (600) and the gun body support (100) so as to ensure that the piston lock (600) can reset after being stressed;

the piston lock (600) is located behind the piston push rod (230), and a locking slot (231) of which the position corresponds to that of the piston lock (600) is formed in the piston push rod (230);

when the piston push rod (230) moves backwards, the locking slot (231) of the piston push rod (230) generates interference with the piston lock (600), and the piston lock (600) avoids temporarily under the action of pushing force to allow the piston push rod (230) to pass through; and after the piston push rod (230) completely passes through the piston lock (600), the locking spring (610) pushes the piston lock (600) to reset to an initial position to be clamped into the locking slot (231) of the piston push rod (230), and the piston push rod (230) is locked at a position after movement afterwards.

7. The toy gun according to claim 6, wherein a sliding stroke in which the motor (400), through the second gear teeth (430), drives the piston push rod (230) is a first stroke distance;

a stroke in which the sliding member (500), through the second loading bump (520), enables the piston push rod (230) to cooperate with the piston lock (600) is a second stroke distance; and the first stroke distance is smaller than the second stroke distance.

8. The toy gun according to claim 1, wherein a trigger (700) is hinged to the gun body support (100), and a micro switch (710) and a trigger bar (720) are arranged on two sides of the trigger (700) respectively;

the micro switch (710) is arranged on an electric loop of the motor (400), and when the trigger (700) rotates, the trigger (700) generates interference with the micro switch (710) to enable the micro switch (710) to be switched on; and two ends of the trigger bar (720) are abutted against the trigger (700) and the piston lock (600) respectively, and when the trigger (700) rotates, the trigger (700), through the trigger bar (720), drives the piston lock (600) to be away from the piston push rod (230).

9. The toy gun according to claim 1, further comprising a gear switch (800), wherein the gear switch (800) is arranged on the electric loop of the motor (400).

10. The toy gun according to claim 9, further comprising a gear sliding block (810), wherein the gear sliding block (810) is slidably arranged on the gun body support (100) to be abutted against the gear switch (800);

a limiting bump (811) is arranged on the gear sliding block (810), and a limiting slot (530) is formed in a lower edge of the sliding member (500); and when the gear sliding block (810) controls the gear switch (800) to be switched off, the limiting bump (811) is separated from the limiting slot (530), and when the gear sliding block (810) controls the gear switch (800) to be switched on, the limiting bump (811) is located in the limiting slot (530) to be used for limiting the sliding stroke of the sliding member (500).

11. The toy gun according to claim 1, further comprising a pellet supplying sliding block (900) slidably mounted on the gun body support (100), wherein the pellet supplying sliding block (900) is located behind the outer sleeve (220), and the pellet supplying sliding block (900) extends to the pellet clip bin to form a pellet supplying bump (910); and when moving backwards, the outer sleeve (220) generates interference with the pellet supplying sliding block (900) and drives the pellet supplying sliding block (900) to slide backwards, and the pellet supplying bump (910) is used for driving a pellet clip (300) to supply pellets.

12. The toy gun according to claim 11, wherein the pellet clip (300) is detachably mounted in the pellet clip bin and the pellet clip (300) comprises:

a pellet bin (310) used for accommodating the pellets, wherein a rotating wheel (320) is arranged at a bottom end of the pellet bin (310);

the rotating wheel (320) mounted at the bottom end of the pellet bin (310), wherein a pellet supplying gap is formed between the rotating wheel and the bottom end of the pellet bin (310), and grooves for accommodating the pellets are formed in the edge of the rotating wheel (320);

a pellet pipeline (330), wherein one end of the pellet pipeline (330) communicates with the pellet supplying pipeline (120), the other end of the pellet pipeline extends to the rotating wheel (320), one side of the rotating wheel (320), that is close to the pellet bin (310), is a pellet inlet (321), one side of the rotating wheel (320), that is close to the pellet pipeline (330), is a pellet supplying opening (322), and when the rotating wheel (320) rotates, the grooves are used for transferring the pellets of the pellet bin (310) to the pellet pipeline (330).

13. The toy gun according to claim 12, wherein the rotating wheel (320) is provided with a notch wheel (340) which is concentric therewith and located outside the pellet bin (310);

a bar assembly (350) is slidably arranged in the pellet clip (300), one end of the bar assembly (350) extends to a top end of the pellet clip (300), and the other end of the bar assembly extends to the notch wheel (340); and a pawl for driving the notch wheel (340) to rotate is arranged at a bottom end of the bar assembly (350), the pellet supplying bump (910) is provided with a bevel for driving the bar assembly (350) to perform downward compressing, and when the pellet supplying bump (910) of the pellet supplying sliding block (900) generates interference with the bar assembly (350) and drives the bar assembly (350) to slide downwards, the pawl drives the notch wheel (340) to rotate.

* * * * *